United States Patent [19]

Martin

[11] 3,946,952

[45] Mar. 30, 1976

[54] HAMMER MILLS

[76] Inventor: Elam M. Martin, R.R. No. 3, Wallenstin, Ontario, Canada

[22] Filed: June 11, 1974

[21] Appl. No.: 478,270

Related U.S. Application Data

[63] Continuation of Ser. No. 255,009, May 19, 1972, abandoned.

[52] U.S. Cl. ..... 241/56; 241/186.2; 241/189 R

[51] Int. Cl.[2] ..... B02C 23/24

[58] Field of Search ..... 241/55, 56, 185 R, 186 R, 241/186.2, 186.3, 189 R, 195, 285, 292.1

[56] References Cited

UNITED STATES PATENTS

| | | | |
|---|---|---|---|
| 2,008,841 | 7/1935 | Sherman | 241/186.2 |
| 2,241,667 | 5/1941 | Mankoff | 241/186 R X |
| 2,291,815 | 8/1942 | Korum | 241/186.2 |
| 3,186,651 | 6/1965 | Briolini | 241/195 X |

*Primary Examiner*—Granville Y. Custer, Jr.
*Attorney, Agent, or Firm*—C. C. Kent; K. M. Hill

[57] ABSTRACT

A hammer mill has a grinding chamber and means therein sufficient enough to grind grain in one pass through the chamber and throw it directly if desired to a remote point, together with means for adjusting the grinding chamber intake for grain and especially corncobs and a corncob intake metering attachment. The mill hammers have raked back leading edges to accelerate feed particles to a speed less than that of the hammers, to multiply the number of impacts on the grain. The smoothness of the mill wall can be varied by turning channels located in a recess in the wall so that either the web or the flange edges of the channels face inwardly toward the hammers.

17 Claims, 5 Drawing Figures

HAMMER MILLS

The present application is a continuation of parent application Ser. No. 255,009 filed May 19, 1972, now abandoned.

The present invention relates to hammer mills for feed grinding and particularly to high moisture grain grinding mainly for use in the silo filling of high moisture ear or kernel corn.

There are many hammer mills extant and a prevalent shape of hammer is one which has a leading edge which is progressively stepped back from the base to the apex so as to present riser portions generally perpendicular to the tangent of the disc rim at the location thereon at which they are secured thereto. As a result shattered grain picks up the speed of such a configuration of hammer at the sacrifice of further fragmentating impacts by successive hammers.

Accordingly, a main object of the present invention is to provide a feed grinder which is simple and which has a minimum of moving parts. In a preferred embodiment the grinding rotor may be low enough practically to touch the ground, so that the feeder or intake hopper may also be placed sufficiently low and close to the ground or floor that no other mechanical means are required to feed material into the mill, the feeder or hopper having sufficient slope for material to be ground to slide freely into the grinding chamber form ordinary gravity grain boxes as on wagons, trucks and the like.

A further advantage of a preferred embodiment of the invention resides in the fact that by adjusting the proximity of a certain ledger plate (to be described) relative to the rotating hammers, the machine can be set according to the horsepower with which it is connected and the said ledger plate in the case of ear corn, if set closer to the path of movement of the hammers or blades will hold such corn back for low horsepower consumption at the optimum capacity of the machine and the source of power which at the time is operating the same. Thus the grinder can be set to prevent stalling a tractor or any other power source or can be set to allow only a certain amount of rmp drop without any other mechanical means than a simple moving plate (the said ledger plate).

A further important feature of the present invention resides in the fact that it performs efficiently without employing any screens. Instead of employing screens, the present invention in a preferred embodiment provides a fine texture of ground material by the provision of a set of rub bars which interrupt the smoothness of the interior cylindrical surface of the grinding chamber. These bars are desirably reversible and capable of relative rearrangement according to the fineness of grind required whereby to promote turbulence amongst the grain being ground and increase the amount of impact to which each or most particles are exposed in their travel through the grinding chamber.

A further object of the present invention is to provide a one-pass grinding chamber by which is meant that the material to be ground is never under normal conditions within the grinding chamber for a single full revolution before being discharged from the grinding chamber in a preferred embodiment the grain is thrown from the grinding chamber into an adjacent thrower or blower. Since the grain is thrown, rather than blown, from the grinding chamber very little air volume is required to effect such transfer of ground grain, thus saving power.

Unlike conventional machines having screens for material to pass through when reduced sufficiently in size and in which such material keeps on rotating inside the chamber until the required reduction of size is achieved, by the use of the present machine material is fed into the grinding chamber thereof and is caused to leave it if not directly, then by deflector means communicating with the discharge end of the grinding chamber prior to making a full revolution and is nevertheless, due to the aforesaid rub bars and hammers or blades reduced sufficiently in size and texture to be transferred as just stated.

With the foregoing in view and such other or further purposes, a preferred embodiment of the invention will next be described, with reference to the accompanying drawings, in which.

In the drawings like reference characters designate similar parts in the several Figures.

Preliminary Description

Figure 1:
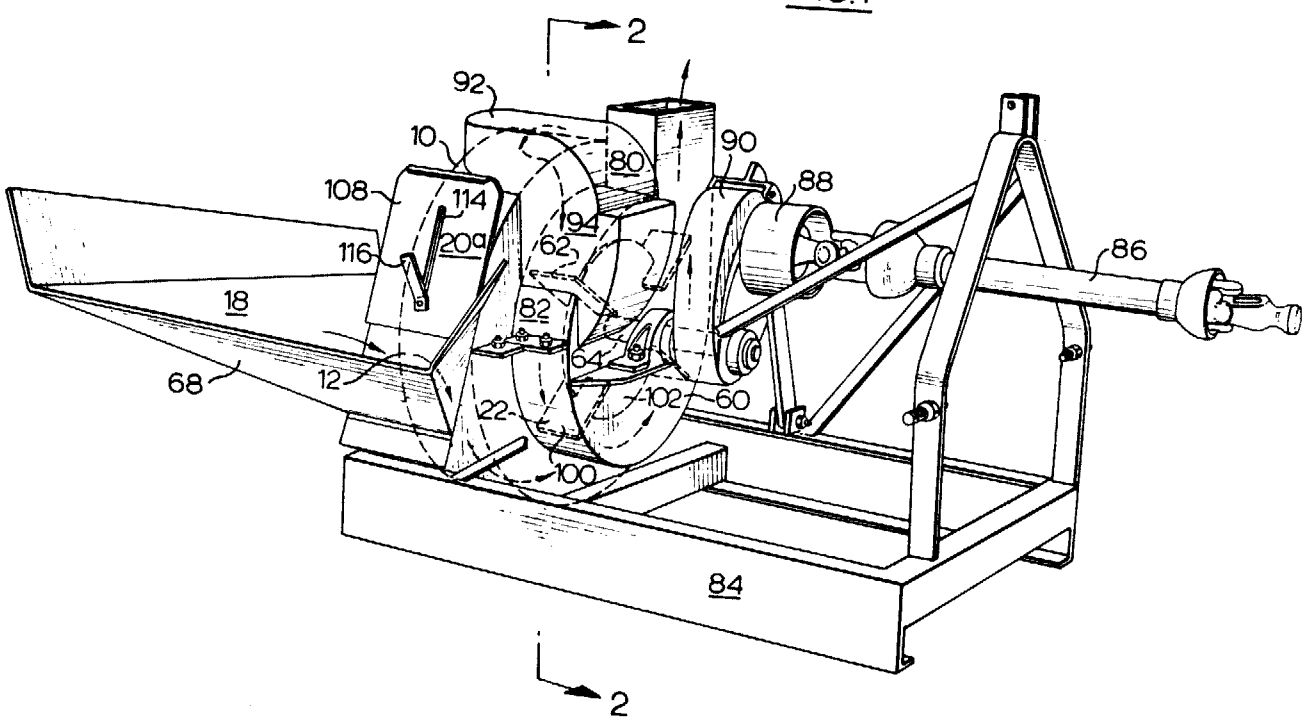
FIG. 1 is a perspective representation of a preferred embodiment of the present invention.
Figure 2:
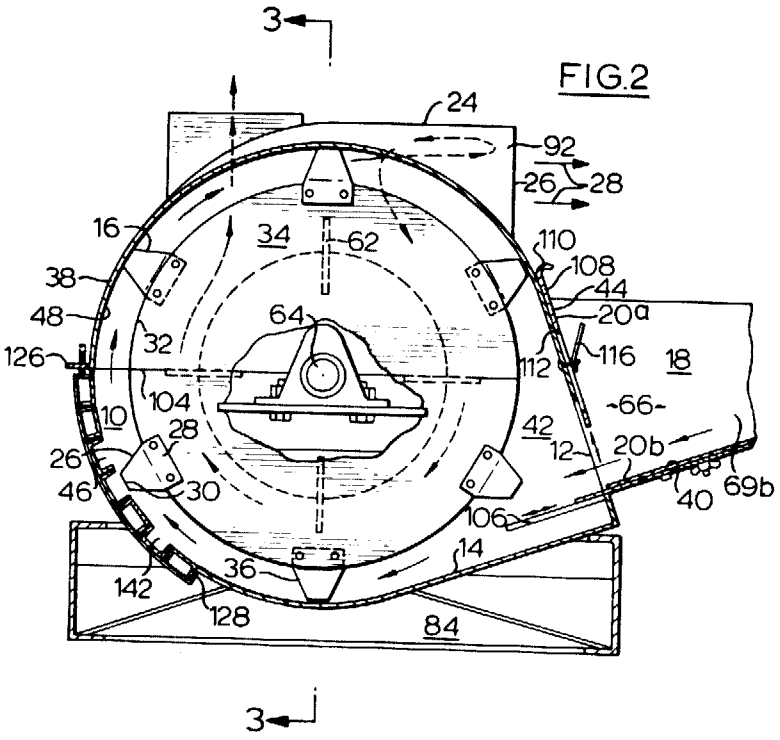
FIG. 2 is a section on the line 2—2 of FIG. 1.

A reference is now made to the drawings, which show a grinder or hammer mill having a generally cylindrical walled grinding chamber 10 having an entrance portal 12, and a sill 14 (FIG. 2) therebelow. Grinding means generally designated 16 are located within the chamber 10. The grain admitted to the chamber 10 is controlled by means for guiding generally designated 18 and by means for controlling generally designated **20*a* and 20*b*. Means generally designated 22 (FIGS. 1, 2) are provided for throwing ground grain from chamber 10 to a remote point which may be a bin, conveyor or the like. In this connection it is also to be particularly understood and appreciated that such means for throwing can also consist of the grinding means 16 when for example the grinding chamber housing collectively designated 24 (FIG. 2) and which is of a generally volute configuration, terminates or is cut off vertically in the region of 26 of FIG. 2 so that grain will be directly discharged from the chamber as indicated by arrows 28**.

The grinding means 16 are in the form of hammers 26 each having an attaching base 28 (FIG. 2) and projecting vertex 30, the hammers being mounted at spaced intervals upon the perimetrical area 32 of the spaced rotating discs 34. Each hammer has a leading edge 36 (FIG. 2) which is rearwardly raked (preferably about 25°) between the base and vertex to shatter the grain. The raked back leading edge 36 impacts the grain a travelling speed within the chamber 10 which is less than that of the hammers 26, thereby multiplying the number of impacts of the edges 36 upon the grain.

Figure 4:
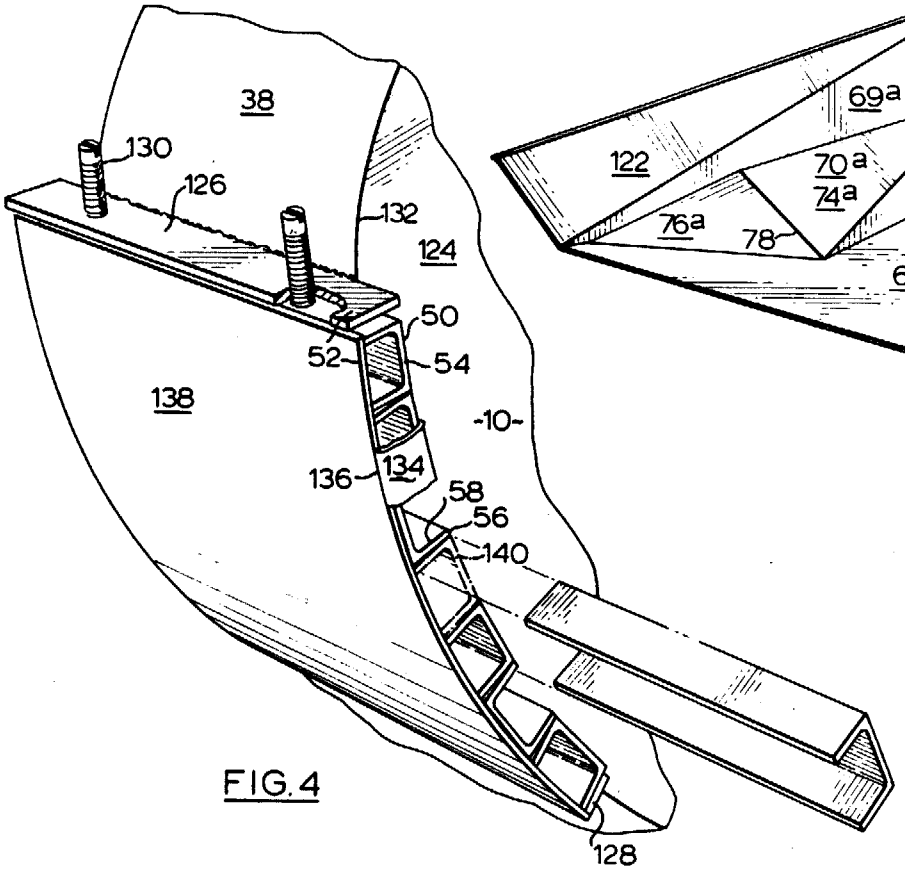
FIG. 4 is an enlarged fragmentary representation of a portion of the grinding chamber housing depicting the smoothness varying means or rub bar assembly.

The grinding chamber 10 includes a substantially cylindrical surround wall, entrace portal 12 lying in an upwardly inclined sub-vertical plane, the sill 14 occupying the plane which is substantially at right angles to the portal, with both portal and sill being tangent to cylindrical wall 38. A ledger plate 40 (constituting a feature of said controlling means **20*b*) is provided, arranged parallel with and spaced from the sill 14 and within the portal area 42 of the chamber 10. The ledger plate 40 is moveable in its plane toward or away from the grinding means 16. Means 44 constituting a feature of means 20***a* are provided for varying the area of entrance portal 12. Means generally designated 46 vary the smoothness of a portion of the inner surface 48 of of the grinding chamber wall 38 such means including an opening in the cylindrical wall 38, and channel stock means collectively designated 50 (FIG. 4). Means generally designated 52 are provided for accommodating said channel stock means within said opening with either the web 54 or edges 56 of flanges 58 of said channel stock means being arcuately co-incident with the produced inner cylindrical surface 48 of the wall 38.

The means 22 for throwing ground grain include a thrower housing 60 located at one side of grinding chamber 10. Rotary thrower means 62 are provided in housing 60, such thrower means being co-axial with the grinding means 16 so that both rotate on the main drive shaft 64.

The thrower housing 60 is a volute and is connected to the grinding chamber 10 by a serpentine connecting trunk 80. The trunk 80 extends from the summit of said grinding chamber downwardly and beside the grinding chamber into an upper quadrant 82 of the volute thrower housing 60.

Figure 5:
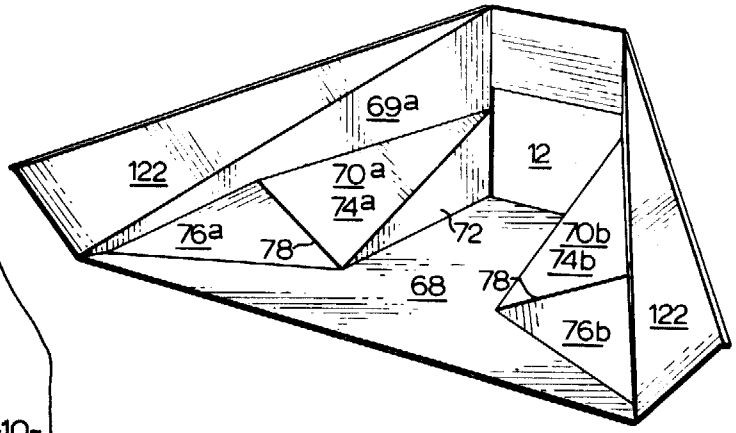
FIG. 5 is a perspective representation of the receiving hopper and ear corn admission facilitating polyhedral attachments connected thereto.

The guiding means 18 include a receiving hopper 66 (FIG. 2) which is attached to and projects from portal 12. The hopper 66 has (see FIG. 5) a floor plate 68 co-planar with sill 14, a pair of upstanding sides 69*a* and 69*b*, and a pair of polyhedrons collectively designated 70*a* and 70*b* on either side of said portal having a pair of parallel upstanding triangular entrance walls 72 spaced by not more than the width of portal 12 to define therebetween a passage. The polyhedrons 70*a* and 70*b* are supported on floor plate 68 and on interfacially contacting sides 69 for the length thereof, each polyhedron having (i) a triangular upper rear surface plate 74*a*, 74*b*, in contact with one of said entrance walls 72, and (ii) a triangular upper front surface plate 76*a*, 76*b* in edge contact at 78 with one of said rear surface plates, the floorplate and sides, and lying at an obtuse angle (as clearly shown in FIG. 5) to the adjacent rear surface plate 70*a* or 70*b*.

Additional and More Detailed Description

The grinder or hammer mill is suitably supported upon a framework, generally designated 84, which is preferably designed to be ground-supported so that the whole unit is low down and close to the ground floor, as of a barn or the like. The grinder or mill is driven by a source of power connected to shafting 86 or to the pulley 88, 90 representing a gear reduction assembly connected to main shaft 64.

The thrower housing 60 is of volute configuration, concentric with the grinding chamber 10. The serpentine trunk 80 takes on a horizontal right angular curvature 92 at the summit of the grinding chamber and then takes on a vertical downwardly extending right angulated curvature 94 to enter housing 60, in the manner well illustrated in the accompanying FIGS. 1 and 3, being stepped at 96 to provide relatively voluminous intake plenum 98. The thrower means 62 desirably comprises a plurality of paddles 100 secured to the rotating disc 102. These paddles lie perpendicular to the axis of rotation from which it will be plain that they function more specifically as throwers than they do as blowers. Preferably the entire casting or fabricated shape forming the housing of the grinding chamber 10, the housing 60, and the trunk 80 is in two parts which may be separated upon the horizontal axis of the shaft 64 where indicated by numeral 104 of FIG. 2.

Ledger plate 40 moves slidably upon the pair of guides 106 upon either cheek of the portal area 42. The plate 108 has a suitable handhold 110 and moves interfacially up and down against the adjacent surface portion 112 of the grinder housing. Plate 108 is provided with an elongated central aperture 114 (FIG. 1) through which extends a locking lever assembly collectively designated 116.

Figure 3:
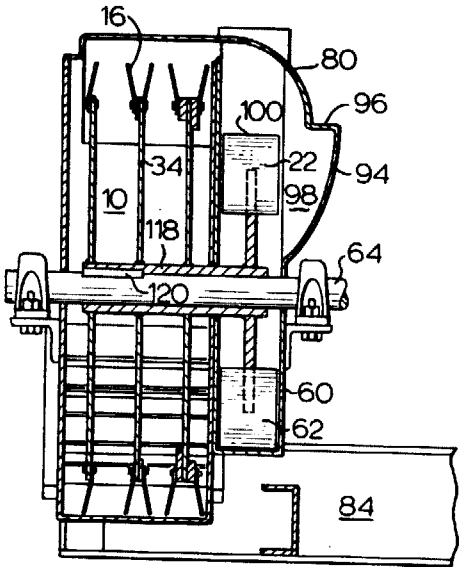
FIG. 3 is a section on the line 3—3 of FIG. 2.

By means of the arrangements just described it is to be understood that when ledger plate 40 is set close to the hammers 26 the high speed rotor formed by the set of discs 34 and the hammers 26 tends to hold back or restrict the inflow of material. Movement of the ledger plate edge further away from the rotor permits material to be precipitated over the edge of plate 40 before actually coming into contact with the grinding mechanism so that faster feeding will result. This feature of the invention is particularly useful for grinding ear corn (corn cobs), which as is well known are hard to feed evenly out of gravity boxes or truck boxes. With regard to the plate 108, for corn cobs this is preferably opened to the full whereas for other grains it is adjusted and partially closed according to the feed rate desired. Typical rim speed of the discs 34 is in the order of 200 mph wherefor suitably tough material is necessary to prevent disintegration and likewise very adequate attaching means of the hammers to the discs but this is well within the skill of the calling. The aforesaid discs are suitably splined to shaft 64 for rotation therewith by way of sleeve 118 and key 120 (FIG. 3).

Receiving hopper 66 is of course suitably secured to grinding chamber 10 and the same has been fully described excepting only for recitation of the pair of outflaired and inclining, outwardly divergent wing plates 122 (FIG. 5) which are attached to and form an obtuse angle with the upstanding sides 69*a* and 69*b* aforesaid.

The means 46 for varying the smoothness of a portion of the inner surface of cylindrical grinding chamber wall 38 (FIGS. 2 & 4) may be positioned elsewhere than shown upon the circumference of the said cylindrical wall. In detail some consist of forming a gap or space or break in the continuity of the wall 38 between the side plates 124 thereof. This space or break in continuity is bounded at each end by the provision of outwardly projecting transversely disposed end plates 126 and 128 which are welded to cylindrical wall 38, plate 126 being provided with a pair of spaced tightening screws 130, the reason for which will presently become clearly apparent.

Welded to the sides 124 of the grinding chamber housing and following the contour of the edge 132 but projecting outwardly, are curved longitudinally right angulated end closing members 134. Spanning the distal edges 136 of the members 134 is a cover plate 138 the curvature of which is, like the members 134 arcuately co-incident with the produced cylindrical wall surface 48. From the just described structure it will be apparent that a deep arcuate recess or container 142 has been provided in the wall 38 of the chamber 10. Located in such recess or container are the channel stock rub bar means 50, which specifically comprise a set of lengths of channel stock 140 which may be placed such that either all the webs 54 are spaced away from the cover plate 138 by the flanges 58 or such that all the webs 54 lie against the cover plate 138 with the flanges 58 directed radially inwardly. Again, it may most frequently be desired that some of the lengths of channel stock be arranged with flanges directed inwardly and others with flanges directed outwardly as in both the accompanying FIGS. 2 and 4, it being understood that either the webs 54 or the flange edges 56, whichever is inboard (i.e. radially innermost) are substantially accurate co-incident with the produced inner cylindrical wall surface 48.

When the bolts 130 are screwed down, it will be apparent that the length of channel stock are secured tightly in position within the described recess provided for same and which, as will be plain from FIG. 4 projects at each end beyond the plane of the grinding chamber side walls 124. It will be apparent that many minor variations in what has just been described with reference to the means for varying the smoothness of the surface of the cylindrical wall 38 may be restored to. Plate 138 may be frictionally held in position or otherwise locked. Again, it may be welded to the portions 134 which may be then unconnected to the grinding chamber housing but nevertheless angulated as described in which case the desired set of channel lengths may be inserted away from the grinder or mill and then brought to it and tightened up.

It will be apparent from this description that the novel feature of introducing uneveness or roughness to the inner surface of a cylindrical grinding chamber wall promotes additional fragmentation and cracking of grain being violently reduced therein. If less turbulence is required, then all webs will be inboard of the opening 142. If maximum shattering impact is required, all flange edges 56 will be inboard. If an effect between these two extremes is desired, then the length of channel stock will be varied as they are illustrated for example in the accompanying drawings.

Various modifications may be constructed or performed within the scope of the inventive concept disclosed. Therefore what has been set forth is intended to illustrate such concept and is not for the purpose of limiting protection to any herein particularly described embodiment thereof.

What I claim is:

1. A feed grinder characterized by having in operative combination:

i. a generally cylindrical-walled grinding chamber having an entrance opening, and grinding means within said chamber for grinding feed in a single pass of said feed through said chamber, ii. means for guiding and controlling the feed admited to said chamber, iii. means for varying the smoothness of a portion of the inner surface of the cylindrical wall thereof, said smoothness varying means embodying a recess in said wall, channel-stock means having a web connecting depending flanges and means for accommodating said channel-stock means within said recess with either the web or flanges of siad channel-stock means being accurately co-incident with said inner cylindrical wall surface.

2. The invention according to claim 1 and including a horizontal and serpentine trunk having a substantially volute end portion communicating mergingly with the summit of said grinding chamber, said entrance opening being substantially tangential and below said grinding chamber summit, the direction of discharge of said feed from said chamber being horizontal and generally opposite in direction to entering feed, means for throwing feed comprising in combination a thrower housing against one side of said grinding chamber, and rotary thrower means in said thrower housing co-axial with said grinding means, said trunk communicating with the side of said thrower housing remote from said grinding chamber.

3. The invention according to claim 1 in which said grinding means are in the form of a plurality of hammers each having an attaching base projecting vertex, mounted at spaced intervals upon the perimetrical area of rotating discs, each hammer having a leading edge which is rearwardly raked between said base and said vertex to strike the feed and to impart to the feed within said chamber a speed less than that of said hammers, thereby to multiply the number of impacts of each edge upon said feed.

4. The invention according to claim 3 and including a horizontal and serpentine trunk having a substantially volute end portion communicating mergingly with the summit of said grinding chamber, said entrance opening being substantially tangential and below said grinding chamber summit, the direction of discharge of said feed from said chamber being horizontal and generally opposite in direction to entering feed, said means for throwing feed comprising in combination a thrower housing against one side of said grinding chamber, said trunk, and rotary thrower means in said thrower housing co-axial with said grinding means, said trunk communicating with the side of said thrower housing remote from said grinding chamber.

5. The invention according to claim 1 in which said grinding chamber includes a substantially cylindrical surrounding wall, said entrance opening lying in an upwardly inclined substantially vertical plane, a sill below and substantially at right angles to said entrance opening, said entrance opening and said sill both being tangent to said cylindrical wall, and a ledger plate parallel with and spaced above said sill within said chamber, said ledger plate being movable toward or away from said grinding means.

6. A feed grinder characterized by having in operative combination:

i. a generally cylindrical-walled grinding chamber having an entrance opening, and grinding means within said chamber, ii. means for guiding and controlling the feed admitted to said chamber, and guiding means embodying in combination a receiving hopper attached to and projecting from said entrance opening, said hopper having a floor plate co-planar with a portion of the boundary of said opening, a pair of upstanding side and a pair of polyhedrons on either side of said opening having a pair of parallel upstanding triangular entrance walls spaced by not more than the width of said opening, said polyhedrons being supported on said floor plate and interfacially contacting said sides for the lengths thereof, each polyhedron having a triangular upper rear surface plate in edge-contact with one of said entrance walls and sides, each polyhedron also having a triangular upper front surface plate in edge-contact with one of said rear surface plates, said floor plate and one side, and lying at an obtuse angle to the adjacent rear surface plate.

7. The invention according to claim 6 and including a ledger plate extending from said opening towards said grinding means, said ledger plate being movable towards and away from said grinding means.

8. The invention according to claim 6 wherein said grinding means are in the form of a plurality of hammers each having an attaching base and projecting vertex, mounted at spaced intervals upon the perimetrical area of rotating discs, each hammer having a leading edge which is rearwardly raked between said base and said vertex to strike the feed and to impart to the feed within said chamber a travelling speed which is less than that of said hammers, thereby to multiply the number of impacts of each edge upon said feed.

9. A feed grinder characterized by having in operative combination:

i. a generally cylindrical-walled grinding chamber having an entrance opening for admitting feed to said chamber, and grinding means within said chamber for grinding feed in a single pass of said feed through said chamber, and ii. means for receiving feed from said chamber and for throwing said feed to a remote point said grinding chamber and said means for receiving and throwing feed comprising in combination a thrower housing to one side of said grinding chamber and rotary thrower means in said housing co-axial with said grinding means, said thrower housing being in the form of a volute, said throwing means including a serpentine connecting trunk extending from the summit of said grinding chamber downwardly therebeside into an upper quadrant of said volute thrower housing.

10. The invention according to claim 9 in which said means for grinding includes a receiving hopper attached to and projecting from said entrance opening, said hopper having a floor plate, a pair of upstanding sides and a pair of polyhedrons on either side of said entrance opening having a pair of parallel upstanding triangular entrance walls spaced by not more than the width of said entrance opening, said polyhedrons being supported on said floor plate and interfacially contacting said sides for the lengths thereof, each polyhedron having a triangular upper rear surface plate in edge-contact with one of said entrance walls and sides, each polyhedron also having a triangular upper front surface plate in edge-contact with one of said rear surface plates, said floor plate, and one side, and lying at an obtuse angle to the adjacent rear surface plate.

11. The invention according to claim 10 and including a ledger plate within said chamber, said ledger plate extending from the bottom edge of said entrance opening towards said grinding means and being movable towards and away from said grinding means.

12. In a feed comminuting machine having an entrance opening, a receiving hopper attached to and projecting from said opening, said hopper having a floor plate co-planar with the lower edge of said opening, a pair of upstanding sides and a pair of polyhedrons on either side of said opening having a pair of parallel upstanding triangular entrance walls spaced by not more than the width of said opening, said polyhedrons being supported on said floor plate and interfacially contacting said sides for the lengths thereof, each polyhedron having a triangular upper rear surface plate in edge-contact with one of said entrance walls and sides, each polyhedron also having a triangular upper front surface plate in edge-contact with one of said rear surface plates, said floor plate and one side, and lying at an obtuse angle to the adjacent rear surface plate.

13. In a feed comminuting maching a feed comminuting housing in the form of a horizontally cylindrical wall of substantially greater diameter than axial length, a downwardly sloping input opening and a sill tangent to said wall near its base, a horizontal discharge opening at its apex, a volute fan chamber against one side of said housing, a feed transfer trunk extending between said housing and said chamber, said trunk comprising a horizontal elbow portion communicating with said discharge opening at one end of said trunk, a vertical elbow portion communicating at its upper end with the other end of said horizontal elbow portion, the lower end of said vertical elbow portion communicating with side of said fan chamber remote from said housing and wholly above the horizontal axial plane of said fan chamber.

14. The invention according to claim 13 including means for varying the smoothness of a portion of the inner surface of the cylindrical wall thereof.

15. A feed grinding machine having:

i. a grinding chamber having a generally cylindrical wall, ii. entrance means in said wall for admitting feed to said chamber, iii. rotary grinding means within said chamber for grinding feed in a single pass of said feed through said chamber, iv. said grinding means including a plurality of hammers each having a base and a projecting vertex, and a leading edge which is rearwardly raked between said base and said vertex, mounting means for said hammers, and means for rotating said mounting means so that said leading edges of said hammers will strike said feed and will impart to said feed a speed less than that of said hammers, thereby to effect multiple impacts of said hammers on a given particle of feed as it travels through said chamber, v. said wall having an exit opening therein at a location spaced substantially in a circumferential direction from said entrance means, said exit opening being substantially unobstructed to permit feed thrown by said hammers to travel through said exit opening at a substantial velocity, vi. and means in said wall for improving the fragmentation of feed in said chamber, said means comprising a recessed area in said wall, and a plurality of members located in said recess, said members having flat surfaces spaced circumferentially apart in said recess, said surfaces extending radially and crosswise in said recess, said fragmentation improving means being located between said entrance means and said exit opening and forming a sealed portion of the periphery of said wall so that feed stopped by said fragmentation improving means remains within said chamber for reimpaction by said hammers.

16. The invention according to claim 15 wherein said fragmentation improving means are located below the level of said exit opening.

17. The invention according to claim 16 wherein said leading edge of each hammer is rearwardly raked, in a straight line extending from its base to its vertex, at an angle of 25 degrees from a radial line through the centre of such hammer, and including means for driving said hammers so that the bases thereof travel at a speed of about 200 miles per hour.

* * * * *